US010259000B2

(12) United States Patent
Yu et al.

(10) Patent No.: US 10,259,000 B2
(45) Date of Patent: Apr. 16, 2019

(54) CIRCUMFERENTIALLY REVOLVING WATER OUTLET DEVICE

(71) Applicant: SINYU TECHNOLOGY (FUJIAN) CO., LTD., Zhangzhou, Fujian (CN)

(72) Inventors: Zhangjun Yu, Fujian (CN); Zhifeng Wu, Fujian (CN)

(73) Assignee: SINYU TECHNOLOGY (FUJIAN) CO., LTD, Fujian (CN)

( * ) Notice: Subject to any disclaimer, the term of this patent is extended or adjusted under 35 U.S.C. 154(b) by 0 days.

(21) Appl. No.: 15/737,278

(22) PCT Filed: Aug. 18, 2015

(86) PCT No.: PCT/CN2015/087346
§ 371 (c)(1),
(2) Date: Dec. 15, 2017

(87) PCT Pub. No.: WO2017/000365
PCT Pub. Date: Jan. 5, 2017

(65) Prior Publication Data

US 2018/0169675 A1 Jun. 21, 2018

(30) Foreign Application Priority Data

Jun. 29, 2015 (CN) ..... 2015 1 0367047

(51) Int. Cl.
*B05B 3/00* (2006.01)
*B05B 3/04* (2006.01)
(Continued)

(52) U.S. Cl.
CPC ..... *B05B 3/0431* (2013.01); *B05B 1/185* (2013.01); *A61H 33/0087* (2013.01)

(58) Field of Classification Search
CPC .. B05B 1/185; B05B 1/18; B05B 1/14; B05B 3/04; B05B 3/0418; B05B 3/0431; B05B 3/042
(Continued)

(56) References Cited

U.S. PATENT DOCUMENTS 1,764,758 A * 6/1930 Slining ..... B05B 3/044 239/242
1,765,939 A * 6/1930 Roach ..... B05B 3/044 239/242
(Continued)

FOREIGN PATENT DOCUMENTS

CN 201446029 U 5/2010
CN 202398444 U 8/2012
(Continued)

OTHER PUBLICATIONS

Office Action for Corresponding CN Application No. 201510367047.6 (8 Pages).
(Continued)

*Primary Examiner* — Viet Le
(74) *Attorney, Agent, or Firm* — Lucas & Mercanti, LLP

(57) ABSTRACT

Disclosed is a circumferentially revolving water outflowing device, having a main body, an upper cover, a lower cover, a water outflowing assembly and a revolving swing. The upper and lower covers are respectively covered on an upper and a lower end face of the main body, forming a water inlet cavity therein. The water inlet cavity is provided therein with an impeller, a speed reduction duplex gear and an output gear. The output gear is provided at an axial center portion thereof with a first rotating shaft, which rotates synchronously therewith, extends through the water inlet cavity out of the lower cover and is fixedly connected to one end of the revolving swing. The other end of the revolving swing is rotationally connected to an upper end face of the
(Continued)

water outflowing seat. The revolving swing drives the water outflowing assembly to rotate under the driving of the output gear.

5 Claims, 2 Drawing Sheets

(51) Int. Cl.
*B05B 1/18* (2006.01)
*A61H 33/00* (2006.01)

(58) Field of Classification Search
USPC ..... 239/237, 240, 242, 225.1
See application file for complete search history.

(56) References Cited

U.S. PATENT DOCUMENTS 2,583,175 A * 1/1952 Hautau ..... B05B 1/12 239/239
2,714,080 A * 7/1955 De Wald ..... B05B 3/007 134/181
2,769,665 A * 11/1956 Spender ..... B05B 3/044 239/242
3,073,532 A * 1/1963 Rinkewich ..... B05B 3/044 239/120
4,218,017 A * 8/1980 Gianfranco ..... B05B 3/044 239/242
4,340,177 A * 7/1982 Huber ..... B05B 1/18 239/242
4,944,457 A * 7/1990 Brewer ..... B05B 3/16 239/242
5,201,468 A * 4/1993 Freier ..... B05B 1/1654 239/383
5,476,225 A * 12/1995 Chan ..... B05B 1/1636 239/449
5,634,888 A * 6/1997 Henkin ..... A61H 33/0087 601/148
5,718,380 A * 2/1998 Schorn ..... B05B 15/5225 239/117
5,765,760 A * 6/1998 Kuo ..... B05B 1/1654 239/437
5,820,574 A * 10/1998 Henkin ..... A61H 23/04 601/160
5,862,985 A * 1/1999 Neibrook ..... B05B 1/1636 239/428.5
5,967,417 A * 10/1999 Mantel ..... B05B 3/04 239/380
6,182,910 B1 * 2/2001 Huen ..... A63F 11/0011 239/289
6,223,998 B1 * 5/2001 Heitzman ..... B05B 3/04 239/383
6,412,711 B1 * 7/2002 Fan ..... B05B 1/1636 239/446
6,814,306 B1 * 11/2004 Okubo ..... B05B 3/04 239/316
6,845,921 B2 * 1/2005 Schorn ..... B05B 3/0418 239/221
7,014,128 B2 * 3/2006 Leung ..... B05B 3/044 239/242
7,584,906 B2 * 9/2009 Lev ..... B05B 1/18 239/222.15
7,818,828 B2 * 10/2010 Zhou ..... B05B 1/1663 137/883
8,020,786 B2 * 9/2011 Lo ..... B05B 1/18 239/237
8,297,538 B2 * 10/2012 Zhou ..... B05B 1/1636 239/391
9,427,749 B2 * 8/2016 Zhou ..... B05B 1/1636
9,943,863 B2 * 4/2018 Huffington ..... B05B 1/185
2001/0008256 A1 * 7/2001 Marsh ..... B05B 1/1645 239/381
2006/0049279 A1 * 3/2006 Miyake ..... B05B 1/1654 239/436
2006/0076436 A1 * 4/2006 Zhadanov ..... B05B 1/1627 239/383
2006/0102747 A1 * 5/2006 Ho ..... B05B 1/18 239/383
2008/0087746 A1 * 4/2008 Meisner ..... B05B 1/1645 239/436
2008/0098512 A1 * 5/2008 Fang ..... A61H 7/005 4/615
2010/0127096 A1 * 5/2010 Leber ..... B05B 3/04 239/101
2011/0215171 A1 * 9/2011 Chen ..... B05B 3/049 239/237
2012/0181353 A1 * 7/2012 Zhou ..... A61H 9/0021 239/101
2013/0032231 A1 * 2/2013 Stein ..... E03C 1/084 137/561 R
2013/0136627 A1 * 5/2013 Zhou ..... B05B 12/12 417/312
2013/0199641 A1 * 8/2013 Zhou ..... B05B 1/1654 137/624.27
2013/0320111 A1 * 12/2013 Zhou ..... B05B 1/18 239/382
2014/0008462 A1 * 1/2014 Gransow ..... B05B 1/18 239/391
2014/0110502 A1 * 4/2014 Yu ..... B05B 1/18 239/240
2014/0131482 A1 * 5/2014 Wu ..... B05B 7/24 239/302
2014/0326805 A1 * 11/2014 Zhou ..... B05B 1/18 239/397
2016/0228887 A1 * 8/2016 Lin ..... B05B 3/0463
2016/0296950 A1 * 10/2016 Tian ..... B05B 1/18
2016/0303587 A1 * 10/2016 Zhou ..... B05B 3/04
2017/0274395 A1 * 9/2017 Xu ..... B05B 3/04
2017/0320076 A1 * 11/2017 Chen ..... B05B 3/04

FOREIGN PATENT DOCUMENTS

CN 202460888 U 10/2012
CN 203972165 U 12/2014
GB 2322572 A 9/1998

OTHER PUBLICATIONS

International Search Report for International Application No. PCT/CN2015/087346 (6 Pages) (dated Mar. 17, 2016).

* cited by examiner

CIRCUMFERENTIALLY REVOLVING WATER OUTLET DEVICE

CROSS-REFERENCE TO RELATED APPLICATIONS

This application is a 371 U.S. of PCT/CN2015/087346 filed Aug. 18, 2015, which claims the priority of Chinese Patent Application No. 201510367047.6 filed Jun. 29, 2015, the contents of each of which are incorporated herein by reference.

TECHNICAL FIELD

The present invention relates to the technical field of bathroom accessory technology, and particularly to a circumferentially revolving water outlet device.

BACKGROUND ART

Nowadays, shower heads have been widely used in daily life, and generally include shower heads at a top (commonly known as shower roses) and hand-held shower heads. As people's living quality improves, the demand for shower heads regarding their water outflowing functions is increasing, and accordingly multi-functional shower heads emerge on the market. However, more functional water patterns of a shower head means higher requirement for the structure of the shower head. But existing shower heads have directed water outlets, leading to an inflexible water outflowing mode and single function, and thus failing to achieve a massage effect.

DISCLOSURE OF THE INVENTION

In order to overcome the shortcomings in the prior art, an object of the present invention is to provide a circumferentially revolving water outlet device which is convenient to use and can achieve the massage effect.

In order to achieve the above object, the present invention adopts the following technical solutions.

A circumferentially revolving water outlet device includes a main body, an upper cover, a lower cover, a water outflowing assembly, and a revolving swing, wherein the upper cover and the lower cover are respectively covered on an upper end face and a lower end face of the main body, forming a water inflowing cavity internally, the main body is provided with a water inlet, and the water inlet is in communication with the water inflowing cavity.

The water inflowing cavity is provided therein with an impeller, a speed reduction duplex gear, and an output gear. An axial end face of the impeller is provided with a driving gear configured to rotate synchronously with the impeller. The driving gear is engaged with a main gear of the speed reduction duplex gear. A pinion of the speed reduction duplex gear is engaged with the output gear. The output gear is provided at an axial center portion thereof with a first rotating shaft configured to rotate synchronously with the output gear. The first rotating shaft extends out of the lower cover through the water inflowing cavity, and is fixedly connected with one end of the revolving swing.

The water outflowing assembly includes a water outflowing seat and a water outflowing nozzle. The water outflowing nozzle is covered on the water outflowing seat, forming a water outflowing cavity internally. A cylindrical boss is provided at a middle portion of an upper end face of the water outflowing seat. The boss extends into the water inflowing cavity through the lower cover. The boss is provided at an axial center portion thereof with a water inflowing passage running through two ends of the boss. A second rotating shaft is provided at an axial center portion of the water inflowing passage. An outer cylindrical wall of the second rotating shaft and an inner wall of the water flowing passage are connected to form one piece through rib plates provided at intervals in a circumferential direction. An upper end of the second rotating shaft passes through the lower cover and is rotationally connected with the main body.

The other end of the revolving swing is rotationally connected with the upper end face of the water outflowing seat, and the revolving swing, when driven by the output gear, drives the water outflowing assembly to revolve.

The revolving swing includes a rotating arm and a connecting rod. One end of the rotating arm is fixedly connected with the first rotating shaft. The other end of the rotating arm is rotationally connected with one end of the connecting rod. And the other end of the connecting rod is rotationally connected with the upper end face of the water outflowing seat.

The lower cover is provided with a first sealing groove at a location corresponding to the first rotating shaft. The first sealing groove is provided therein with a first sealing ring, and the first sealing ring is sleeved outside the first rotating shaft.

The lower cover is provided with a second sealing groove at a location corresponding to the second rotating shaft. The second sealing groove is provided therein with a second sealing ring, and the second sealing ring is sleeved outside the second rotating shaft.

The water outflowing assembly further includes a water outflowing panel covered on a lower end face of the water outflowing nozzle.

With the above technical solutions as adopted by the present invention, water enters the water inflowing cavity through the water inlet of the main body, the impeller is caused to rotate at a high speed under the action of the hydraulic pressure and water speed, then the impeller, through the driving gear, drives the speed reduction duplex gear to rotate, so as to drive the output gear to rotate, and the output gear in turn drives the revolving swing to rotate, so as to drive the water outflowing assembly to rotate, consequently realizing the circumferentially revolving water outflowing of the water outflowing assembly, and achieving a dynamic massage effect. The present invention has a simple structure, is convenient to use, and can give a relaxing and smooth showering experience to a user.

BRIEF DESCRIPTION OF DRAWINGS

Below the present invention is further described in detail in combination with accompanying drawings and embodiments.

DETAILED DESCRIPTION OF EMBODIMENTS

Figure 1:
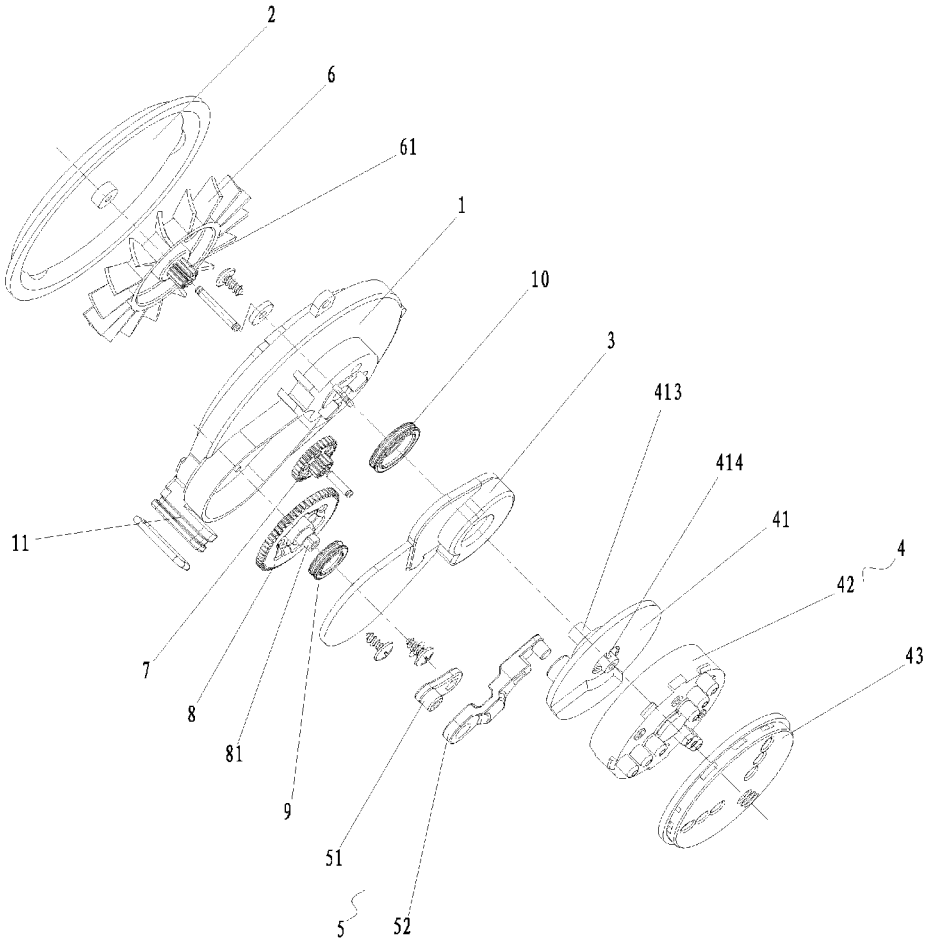
FIG. 1 is an exploded view of a circumferentially revolving water outlet device of the present invention.
Figure 2:
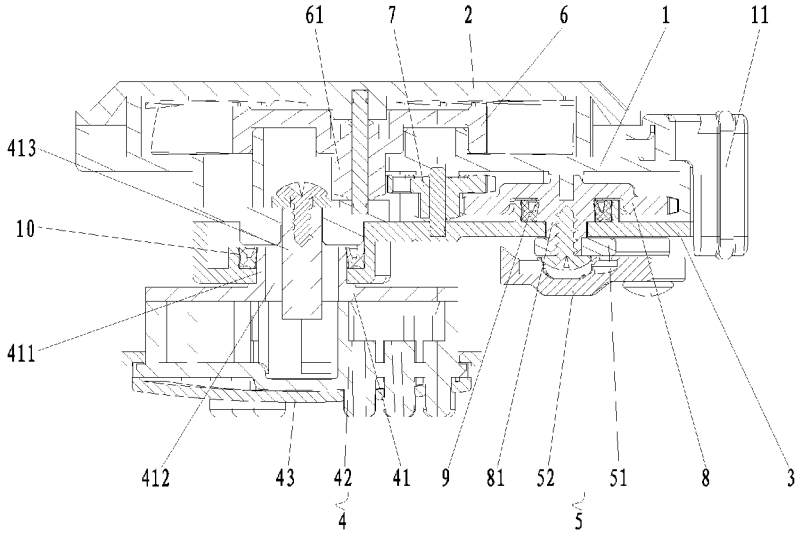
FIG. 2 is a sectional view of a circumferentially revolving water outlet device of the present invention

As shown in FIG. 1 or FIG. 2, the present invention includes a main body 1, an upper cover 2, a lower cover 3, a water outflowing assembly 4, and a revolving swing 5. The upper cover 2 and the lower cover 3 are respectively covered on an upper end face and a lower end face of the main body 1, forming a water inflowing cavity internally. The main body 1 is provided with a water inlet 11, and the water inlet 11 is in communication with the water inflowing cavity.

The water inflowing cavity is provided therein with an impeller 6, a speed reduction duplex gear 7, and an output gear 8. An axial end face of the impeller 6 is provided with a driving gear 61 which rotates synchronously with the impeller. The driving gear 61 is in engagement connection with a main gear of the speed reduction duplex gear 7. A pinion of the speed reduction duplex gear 7 is in engagement connection with the output gear 8. The output gear 8 is provided at an axial center portion thereof with a first rotating shaft 81 which rotates synchronously with the output gear. The first rotating shaft 81 extends out of the lower cover 3 through the water inflowing cavity and is fixedly connected with one end of the revolving swing 5.

The water outflowing assembly 4 includes a water outflowing seat 41 and a water outflowing nozzle 42. The water outflowing nozzle 42 is covered on the water outflowing seat 41, internally forming a water outflowing cavity. A cylindrical boss 411 is provided at a middle portion of an upper end face of the water outflowing seat 41. The boss 411 extends into the water inflowing cavity through the lower cover 3. The boss 411 is provided at an axial center portion thereof with a water inflowing passage 412 running through two ends of the boss. A second rotating shaft 413 is provided at an axial center portion of the water inflowing passage 412. An outer cylindrical wall of the second rotating shaft 413 and an inner wall of the water inflowing passage 412 are connected to form one piece through rib plates 414 provided at intervals in a circumferential direction. An upper end of the second rotating shaft 413 passes through the lower cover 3 and is rotationally connected with the main body 1.

The other end of the revolving swing 5 is rotationally connected with the upper end face of the water outflowing seat 41, and the revolving swing 5, when driven by the output gear 8, drives the water outflowing assembly 4 to revolve.

The revolving swing 5 includes a rotating arm 51 and a connecting rod 52. One end of the rotating arm 51 is fixedly connected with the first rotating shaft 81, and the other end of the rotating arm 51 is rotationally connected with one end of the connecting rod 52. The other end of the connecting rod 52 is rotationally connected with the upper end face of the water outflowing seat.

The lower cover 3 is provided with a first sealing groove 9 at a location corresponding to the first rotating shaft 81. The first sealing groove 9 is provided therein with a first sealing ring, and the first sealing ring is sleeved outside the first rotating shaft 81.

The lower cover 3 is provided with a second sealing groove at a location corresponding to the second rotating shaft 413. The second sealing groove is provided therein with a second sealing ring 10, and the second sealing ring 10 is sleeved outside the second rotating shaft 413.

The water outflowing assembly 4 further includes a water outflowing panel 43 covered on the lower end face of the water outflowing nozzle 42.

The working principle of the present invention is as follows: water enters the water inflowing cavity through the water inlet 11 of the main body 1, the impeller 6 is caused to rotate at a high speed under the action of the hydraulic pressure and water speed, then the impeller 6, through the driving gear 61, drives the speed reduction duplex gear 7 to rotate, and thereby drives the output gear 8 to rotate, and the output gear 8 in turn drives the revolving swing 5 to rotate, so as to drive the water outflowing assembly 4 to rotate, consequently realizing the circumferentially revolving water outflowing of the water outflowing assembly 4, and achieving a dynamic massage effect. The present invention is has a simple structure, is convenient to use, and can give a relaxing and smooth showering experience to a user.

The invention claimed is:

1. A circumferentially revolving water outlet device, comprising a main body, an upper cover, a lower cover, a water outflowing assembly, and a revolving swing, wherein the upper cover and the lower cover cover an upper end face and a lower end face of the main body, respectively, internally forming a water inflowing cavity, the main body is provided with a water inlet, and the water inlet is in communication with the water inflowing cavity, the water inflowing cavity is provided therein with an impeller, a speed reduction duplex gear, and an output gear, an axial end face of the impeller is provided with a driving gear configured to rotate synchronously with the impeller, the driving gear is engaged with a main gear of the speed reduction duplex gear, a pinion of the speed reduction duplex gear is engaged with the output gear, the output gear is provided at an axial center portion thereof with a first rotating shaft configured to rotate synchronously with the output gear, and the first rotating shaft extends out of the lower cover through the water inflowing cavity, and is fixedly connected with one end of the revolving swing; the water outflowing assembly comprises a water outflowing seat and a water outflowing nozzle, the water outflowing nozzle is covered on the water outflowing seat, forming a water outflowing cavity internally, a cylindrical boss is provided at a middle portion of an upper end face of the water outflowing seat, the boss extends into the water inflowing cavity through the lower cover, the boss is provided at an axial center portion thereof with a water inflowing passage running through two ends of the boss, a second rotating shaft is provided at an axial center portion of the water inflowing passage, an outer cylindrical wall of the second rotating shaft and an inner wall of the water inflowing passage are connected to form one piece through rib plates provided at intervals in a circumferential direction, and an upper end of the second rotating shaft passes through the lower cover and is rotationally connected with the main body; and another end of the revolving swing is rotationally connected with the upper end face of the water outflowing seat, and the revolving swing is configured to drive, when driven by the output gear, the water outflowing assembly to revolve.

2. The circumferentially revolving water outlet device of claim 1, wherein the revolving swing comprises a rotating arm and a connecting rod, one end of the rotating arm is fixedly connected with the first rotating shaft, other end of the rotating arm is rotationally connected with one end of the connecting rod, and other end of the connecting rod is rotationally connected with the upper end face of the water outflowing seat.

3. The circumferentially revolving water outlet device of claim 1, wherein the lower cover is provided with a first sealing groove at a location corresponding to the first rotating shaft, the first sealing groove is provided therein with a first sealing ring, and the first sealing ring is sleeved outside the first rotating shaft.

4. The circumferentially revolving water outlet device of claim 3, wherein the lower cover is provided with a second sealing groove at a location corresponding to the second is rotating shaft, the second sealing groove is provided therein with a second sealing ring, and the second sealing ring is sleeved outside the second rotating shaft.

5. The circumferentially revolving water outlet device of claim 1, wherein the water outflowing assembly further comprises a water outflowing panel covering a lower end face of the water outflowing nozzle.

* * * * *